US008994762B2

(12) United States Patent
Kim et al.

(10) Patent No.: US 8,994,762 B2
(45) Date of Patent: Mar. 31, 2015

(54) APPARATUS GENERATING GRAY SCALE VOLTAGE FOR ORGANIC LIGHT EMITTING DIODE DISPLAY DEVICE AND GENERATING METHOD THEREOF

(75) Inventors: Sang-Rak Kim, Yongin (KR); Jeong-Geun Yoo, Yongin (KR); Min-Weun Kim, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 356 days.

(21) Appl. No.: 13/530,301

(22) Filed: Jun. 22, 2012

(65) Prior Publication Data

US 2013/0249955 A1 Sep. 26, 2013

(30) Foreign Application Priority Data

Mar. 26, 2012 (KR) ..... 10-2012-0030586

(51) Int. Cl.
*G09G 5/10* (2006.01)
*G09G 3/32* (2006.01)

(52) U.S. Cl.
CPC ..... *G09G 3/3233* (2013.01); *G09G 2320/0626* (2013.01); *G09G 2320/0666* (2013.01); *G09G 2320/0673* (2013.01); *G09G 2330/028* (2013.01)
USPC ..... 345/690; 345/77

(58) Field of Classification Search
CPC ..... G09G 5/10
USPC ..... 345/77, 204, 211, 690
See application file for complete search history.

(56) References Cited

U.S. PATENT DOCUMENTS

2008/0278521 A1* 11/2008 Kang ..... 345/690
2009/0219306 A1 9/2009 Oh et al.
2011/0109661 A1* 5/2011 Lee ..... 345/690
2012/0032995 A1* 2/2012 Lee ..... 345/690
2012/0062609 A1 3/2012 Jeon

FOREIGN PATENT DOCUMENTS

KR 10-2004-0049727 A 6/2004
KR 10-2009-0093018 A 9/2009
KR 10-1034755 B1 5/2011
KR 10-2012-0028007 A 3/2012

* cited by examiner

*Primary Examiner* — Pegeman Karimi
(74) *Attorney, Agent, or Firm* — Lee & Morse, P.C.

(57) ABSTRACT

An apparatus for generating gray scale voltage includes a brightness/color coordinate correction unit having a gamma table including data corresponding to an image displayed on a pixel unit of an OLED device at a first brightness level, and a gamma reference voltage look-up table including voltage values of red, green, and blue data corresponding to each gray scale and brightness values at the first brightness level in accordance with the gamma table, a gamma control signal output unit configured to output a gamma reference voltage control signal corresponding to a second brightness level in accordance with the gamma table and the gamma reference voltage look-up table, and a gamma correction circuit configured to receive the gamma reference voltage control signal, to generate gray scale voltages corresponding to the second brightness level, and to output the generated gray scale voltages to a data driver.

11 Claims, 6 Drawing Sheets

| Gray | Brightness | Output voltage (V) | | |
|---|---|---|---|---|
| | | R | G | B |
| 0 | 0.00 | 4.6000 | 4.6000 | 4.6000 |
| 1 | 0.00 | 4.3240 | 4.3240 | 4.3240 |
| 2 | 0.01 | 4.2694 | 4.2927 | 4.2676 |
| 3 | 0.02 | 4.2149 | 4.2615 | 4.2111 |
| 4 | 0.03 | 4.1603 | 4.2302 | 4.1547 |
| 5 | 0.05 | 4.1058 | 4.1990 | 4.0983 |
| ⋮ | ⋮ | ⋮ | ⋮ | ⋮ |
| 250 | 287.21 | 2.5975 | 2.7638 | 2.3127 |
| 251 | 289.74 | 2.5932 | 2.7599 | 2.3071 |
| 252 | 292.29 | 2.5889 | 2.7561 | 2.3015 |
| 253 | 294.85 | 2.5846 | 2.7523 | 2.2959 |
| 254 | 297.42 | 2.5803 | 2.7485 | 2.2903 |
| 255 | 300.00 | 2.5760 | 2.7447 | 2.2847 |

FIG. 5C

| | Gray | Brightness | Output voltage (V) | | |
|---|---|---|---|---|---|
| | | | R | G | B |
| | 0 | 0.00 | 4.6000 | 4.6000 | 4.6000 |
| V1 | 1 | 0.00 | 4.3240 | 4.3240 | 4.3240 |
| | 2 | 0.01 | 4.2694 | 4.2927 | 4.2676 |
| | ⋮ | ⋮ | ⋮ | ⋮ | ⋮ |
| | 8 | 0.15 | 3.9639 | 4.1177 | 3.9516 |
| V15 | 9 | 0.19 | 3.9203 | 4.0927 | 3.9064 |
| | 10 | 0.24 | 3.8875 | 4.0740 | 3.6726 |
| | ⋮ | ⋮ | ⋮ | ⋮ | ⋮ |
| | 20 | 1.11 | 3.7222 | 3.9149 | 3.6919 |
| V35 | 21 | 1.23 | 3.7153 | 3.8981 | 3.6828 |
| | 22 | 1.37 | 3.7085 | 3.8813 | 3.6738 |
| | ⋮ | ⋮ | ⋮ | ⋮ | ⋮ |
| | 34 | 3.56 | 3.6414 | 3.7174 | 3.5856 |
| V59 | 35 | 3.80 | 3.6363 | 3.7048 | 3.5788 |
| | 36 | 4.04 | 3.6295 | 3.6980 | 3.5712 |
| | ⋮ | ⋮ | ⋮ | ⋮ | ⋮ |
| | 51 | 8.70 | 3.5283 | 3.5955 | 3.4570 |
| V87 | 52 | 9.08 | 3.5215 | 3.5887 | 3.4494 |
| | 53 | 9.47 | 3.5148 | 3.5819 | 3.4418 |
| | ⋮ | ⋮ | ⋮ | ⋮ | ⋮ |
| | 102 | 39.96 | 3.2428 | 3.3368 | 3.1305 |
| V171 | 103 | 40.83 | 3.2384 | 3.3329 | 3.1251 |
| | 104 | 41.71 | 3.2339 | 3.3290 | 3.1197 |
| | ⋮ | ⋮ | ⋮ | ⋮ | ⋮ |
| | 153 | 97.51 | 3.0164 | 3.1363 | 2.8539 |
| V255 | 154 | 98.92 | 3.0120 | 3.1323 | 2.8485 |
| | ⋮ | ⋮ | ⋮ | ⋮ | ⋮ |

APPARATUS GENERATING GRAY SCALE VOLTAGE FOR ORGANIC LIGHT EMITTING DIODE DISPLAY DEVICE AND GENERATING METHOD THEREOF

CROSS-REFERENCE TO RELATED APPLICATION

This application claims priority to and the benefit of Korean Patent Application No. 10-2012-0030586, filed on Mar. 26, 2012, in the Korean Intellectual Property Office, the entire content of which is incorporated herein by reference.

BACKGROUND

1. Field

Example embodiments relate to an organic light emitting display device, and more particularly, to an apparatus and method of generating a gray scale voltage of an organic light emitting display device capable of implementing a continuous dimming mode.

2. Description of the Related Art

An organic light emitting display device, which is a kind of flat panel display device using an organic compound as a light emitting material, may have excellent brightness and color purity, may be thin and light, and may be driven at a low power. Therefore, the organic light emitting display device may be used in various display devices, e.g., a portable display device. However, it may be difficult to implement a dimming mode when adjusting brightness (luminance) of a displayed image in a conventional organic light emitting display device.

SUMMARY

Example embodiments are directed toward an apparatus generating gray scale voltage for an OLED display device capable of naturally implementing a continuous dimming mode by generating a gamma reference voltage, which is appropriate for any selected brightness, instead of dividing a brightness level into several fixed steps and generating optimal gray scale voltage based on the generated gamma reference voltage, and a generating method thereof.

According to an exemplary embodiment, there is provided an apparatus for generating gray scale voltage for an OLED display device, the apparatus having a brightness/color coordinate correction unit including a gamma table and a gamma reference voltage look-up table, the gamma table including data corresponding to an image displayed on a pixel unit of the OLED device at a first brightness level, and the gamma reference voltage look-up table including voltage values of red, green, and blue data corresponding to each gray scale and brightness values at the first brightness level in accordance with the gamma table, a gamma control signal output unit configured to output a gamma reference voltage control signal corresponding to a second brightness level in accordance with the gamma table and the gamma reference voltage look-up table, and a gamma correction circuit configured to receive the gamma reference voltage control signal, to generate gray scale voltages corresponding to the second brightness level, and to output the generated gray scale voltages to a data driver.

The first brightness level may be a maximum brightness level.

The maximum brightness level may be about 300 cd/m$^2$.

The gamma correction circuit may be configured to generate a plurality of reference voltages and to distribute voltages between the plurality of reference voltages to generate the gray scale voltages.

The gamma reference voltage control signal may be configured to control voltage values corresponding to the second brightness level in accordance with the gamma reference voltage look-up table, the voltage values corresponding to the reference voltages generated in the gamma correction circuit.

The gamma table may be set by applying a reference offset value to a preset reference gray scale in accordance with the first brightness level and by applying an additional offset value to at least one gray scale other than the preset reference gray scale for performing a gamma voltage correction.

The gamma table may be set by further applying a reference color coordinate offset to the preset reference gray scale based on the first brightness level, and an additional color coordinate offset value to the at least one gray scale other than the reference gray scale.

According to another exemplary embodiment, there is provided a method of generating a gray scale voltage of an OLED display device, the method including setting a gamma table including data corresponding to an image displayed on a pixel unit of the OLED device at a first brightness level, implementing a gamma reference look-up table including voltage values of red, green, and blue data corresponding to each gray scale and brightness values at the first brightness level in accordance with the gamma table, selecting a second brightness level different from a current brightness level, outputting a gamma reference voltage control signal corresponding to the second brightness level in accordance with gamma table and the gamma reference voltage look-up table, generating gray scale voltages corresponding to the second brightness level in gamma reference voltage control signal, and outputting the generated gray scale voltages to a data driver.

The first brightness level may be a maximum brightness level.

The gray scale voltages may be generated by generating a plurality of reference voltages and distributing voltages between the reference voltages in a gamma correction circuit.

The gamma reference voltage control signal may be a signal controlling the voltage values of data calculated corresponding to the second brightness level by the gamma reference voltage look-up table so as to be set to the reference voltages generated in the gamma correction circuit.

The gamma table may be set by applying a reference offset value for performing gamma voltage correction on a preset reference gray scale based the first brightness level and an additional offset value for performing the gamma voltage correction on at least one gray scale other than the reference gray scale.

The gamma table may be set by additionally applying a reference color coordinate offset value for the preset reference gray scale based on the first brightness level, and an additional color coordinate offset value for the at least one gray scale other than the reference gray scale.

BRIEF DESCRIPTION OF THE DRAWINGS

The accompanying drawings, together with the specification, illustrate exemplary embodiments of the example embodiments, and, together with the description, serve to explain the principles of the example embodiments.

FIG. 5C is a diagram showing examples of red, green, blue data voltage selected in the case in which a certain dimming step (100 cd/$m^2$) is selected.

DETAILED DESCRIPTION

Korean Patent Application No. 10-2012-0030586, filed on Mar. 26, 2012, in the Korean Intellectual Property Office, and entitled: "Apparatus of generating gray scale voltage for Organic Light Emitting Display Device and generating method thereof" is incorporated by reference herein in its entirety.

Hereinafter, exemplary embodiments will be described in detail with reference to the accompanying drawings.

Figure 1:
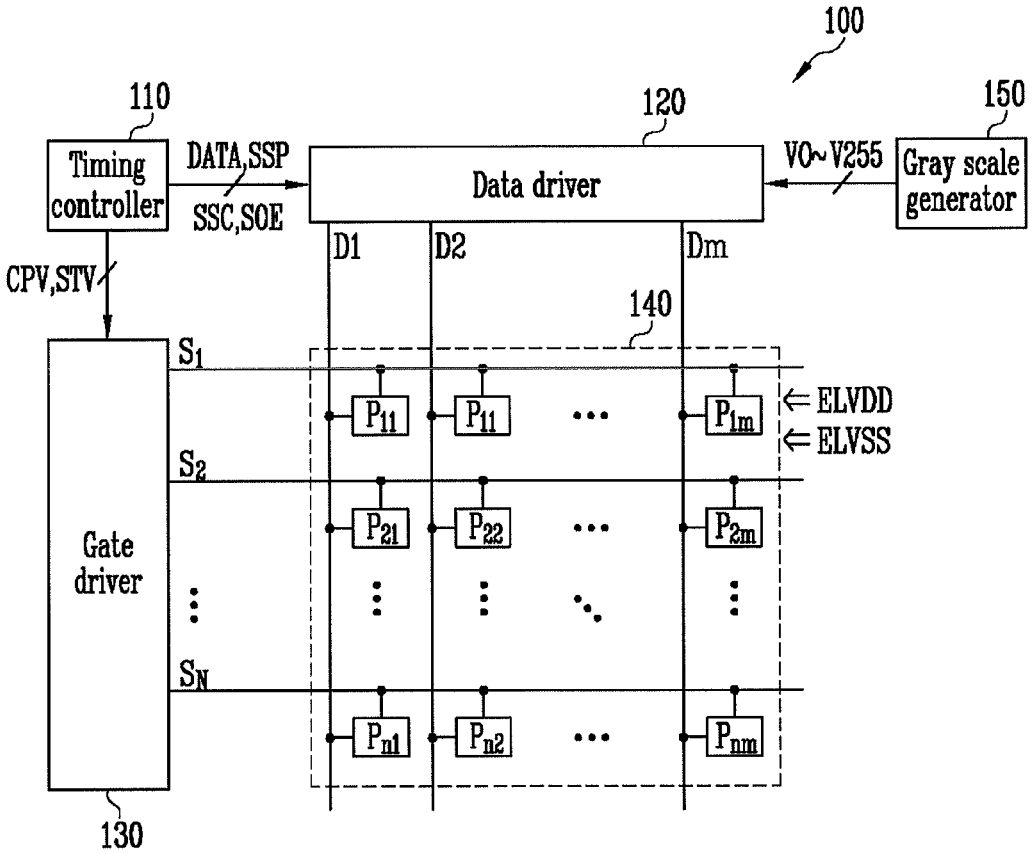
FIG. 1 is a diagram showing a structure of an organic light emitting display device according to an exemplary embodiment.

FIG. 1 is a diagram of an organic light emitting diode (OLED) display device according to an exemplary embodiment.

Referring to FIG. 1, an OLED display device 100 according to the exemplary embodiment is configured to include a timing controller 110 generating and outputting control signals to a data driver 120 and to a gate driver 130, the data driver 120 outputting data voltage corresponding to an input image to each of a plurality of pixels P11 to Pnm through data lines D1 to Dm, the gate driver 130 outputting scan signals to each of the plurality of pixels P11 to Pnm through scan lines S1 to Sn, a pixel unit 140 including the pixels P11 to Pnm connected to the scan lines S1 to Sn and the data lines D1 to Dm, and a gray scale generator 150 generating and providing a plurality of gray scale voltages V0 to V255 to the data driver 120. The gate driver 130 may also serve to output a light emitting control signal to a plurality of light emitting control lines (not shown) connected to the plurality of pixels as well as outputting the scan signals.

The timing controller 110 receives an input image signal and an input control signal controlling display of the input image signal from an external graphic controller (not shown). The timing controller 110 generates input image data DATA, a source start pulse SSP, a source shift clock SSC, a source output enable signal SOE, and the like, from the input image signal and the input control signal to provide them to the data driver 120. Further, the timing controller 110 generates a gate driving clock CPV and a start pulse STV, and the like, to output them to the gate driver 130.

The pixel unit 140 includes the pixels P11 to Pnm positioned at intersection portions of the scan lines Si to Sn and the data lines D1 and Dm. The pixels P11 to Pnm may be arranged in a matrix form, as shown in FIG. 1. Each of the pixels P11 to Pnm includes a light emitting device, e.g., an organic light emitting diode (OLED), and receives a high power supply voltage ELVDD and a low power supply voltage ELVSS from the outside so that the light emitting device emits light. In addition, each of the pixels P11 to Pnm supplies, e.g., controls a supplied amount of, a driving current or voltage to the light emitting device corresponding to the data voltage transferred through the data lines D1 to Dm, such that the light emitting device emits light at a brightness corresponding to the data voltage.

Figure 2:
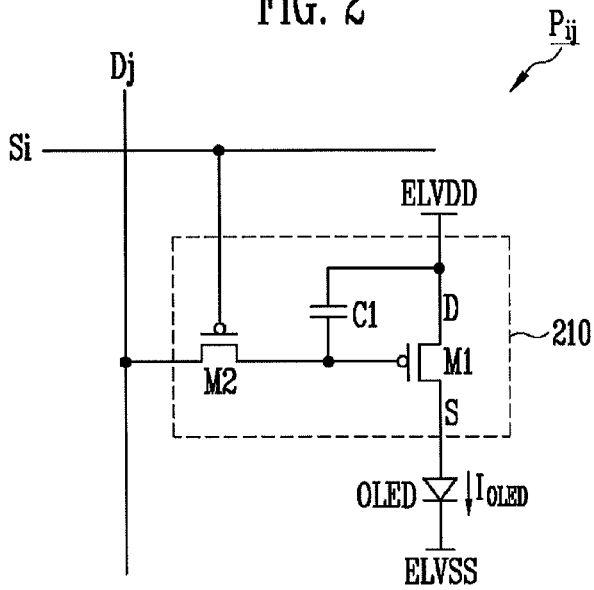
FIG. 2 is a circuit diagram showing an exemplary structure of a pixel (Pij) shown in FIG. 1.

FIG. 2 is a circuit diagram showing an exemplary structure of a pixel (Pij) shown in FIG. 1. It is noted, however, that the OLED display device 100 according to the exemplary embodiments is not limited to the pixel (Pij) of FIG. 2.

Referring to FIG. 2, the pixel Pij according to the exemplary embodiment includes the OLED as the light emitting device and a pixel circuit 210. The OLED receives a driving current $I_{OLED}$ output from the pixel circuit 210 to emit light and the brightness of the light emitted from the OLED is varied according to a magnitude of the driving current $I_{OLED}$.

The pixel circuit 210 may include a capacitor C1, a driving transistor M1, and a switching transistor M2. The driving transistor M1 includes a first terminal D receiving the high power supply voltage ELVDD, a second terminal S connected to an anode of the OLED, and a gate terminal connected to a second terminal of the switching transistor M2. The anode of the OLED is connected to the second terminal S of the driving transistor M1 and a cathode of the OLED is connected to the low power supply voltage ELVSS.

The switching transistor M2 includes a first terminal connected to the data line Dj, the second terminal connected to the gate terminal of the driving transistor M1, and a gate terminal connected to the scan line S1. The capacitor C1 is connected between the gate terminal and the first terminal D of the driving transistor M1.

When the scan signal having a gate-on level is applied to the switching transistor M2 through the scan line Si, the data voltage is applied to the gate terminal of the driving transistor M1 and the first terminal of the capacitor C1 through the switching transistor M2. During application of an effective data voltage through the data line Dj, a voltage corresponding to a voltage level of the data voltage is charged in the capacitor. The driving transistor M1 generates the driving current $I_{OLED}$ according to the voltage level of the data voltage to output it to the OLED. The OLED receives the driving current $I_{OLED}$ input from the pixel circuit 210 to emit light at the brightness corresponding to the data voltage.

Referring back to FIG. 1, the data driver 120 generates data voltages using the input image data DATA, the source start pulse SSP, the source shift clock SSC, the source output enable signal SOE, and the like, input from the timing generator 110 to output them to the plurality of pixels P11 to Pnm through the data lines D1 to Dm. The data voltages may be output to a plurality of pixels positioned in a same row during one horizontal period, respectively. Further, each of the plurality of data lines D1 to Dm transferring the data voltages may be connected to the plurality of pixels positioned in the same row.

Figure 3:
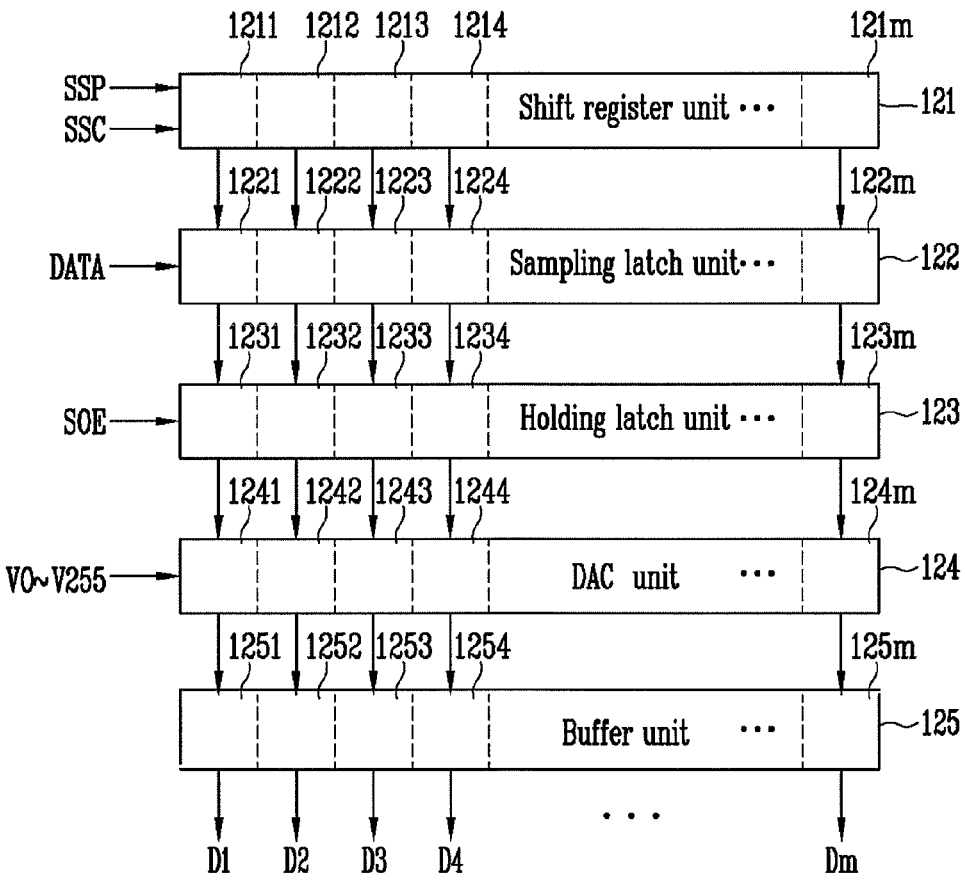
FIG. 3 is a diagram showing a structure of a data driver according to the exemplary embodiment.

FIG. 3 is a diagram showing a structure of a data driver according to the exemplary embodiment. Referring to FIG. 3, the data driver 120 includes a shift register unit 121, a sampling latch unit 122, a holding latch unit 123, a digital-to-analog converter (DAC) unit 124, and a buffer unit 125.

The shift register unit 121 receives the source start pulse SSP and the source shift clock SSC input from the timing controller 110. The shift register unit 121 receives the source start pulse SSP and the source shift clock SSC and then shifts the source start pulse SSP per one period of the source shift clock SSC to sequentially generate m sampling signals. To this end, the shift register unit 121 includes m shift registers 1211 to 121m.

The sampling latch unit 122 sequentially stores the input image data DATA in response to the sampling signals sequentially supplied from the shift register unit 121. To this end, the sampling latch unit 122 includes m sampling latches 122l to 122m so as to store the m input image data DATA.

The holding latch unit 123 receives the source output enable signal SOE from the timing controller 110 and the input image data DATA input from the sampling latch unit 122 to store them therein. Then, the holding latch unit 123 supplies the input image data DATA stored therein to the DAC unit 124. To this end, the holding latch unit 123 includes m holding latches 1231 to 123m.

The DAC unit 124 receives the input image data DATA input from the holding latch unit 123 and the gray scale voltages V0 to V255 from the gray scale voltage generator 150 to generate m data voltages corresponding to the received input image data. To this end, the DAC unit 124 includes m digital-to-analog converters (DACs) 1241 to 124*m*. That is, the DAC unit 124 generates m data voltages using the DACs 1241 to 124m positioned on each channel to supply the generated data voltages to the buffer unit 125.

The buffer unit 125 supplies the m data voltages supplied from the signal generator 124 to the m data lines D1 to Dm, respectively. To this end, the buffer unit 125 includes m buffers 1251 to 125m.

Referring back to FIG. 1, the gate driver 130 generates the scan signals using the gate driving clock CPV, the start pulse STV, and the like, input from the timing controller 110 to output the generated scan signals to the pixels P11 to Pnm through each scan line Si to Sn, respectively. In addition, as described above, the gate driver 130 may also output the light emitting control signals to the pixels P11 to Pnm through light emitting control lines (not shown), respectively. That is, the scan lines Si to Sn and the light emitting control lines (not shown) may sequentially or simultaneously output the scan signals and the light emitting control signals in a row unit. According to the implementation of the OLED display device 100, the gate driver 130 may generate additional driving signals to output the generated additional driving signals to each pixel P11 to Pnm.

The gray scale generator 150 generates a plurality of gamma corrected gray scale voltages V0 to V255 to output the generated gamma corrected gray scale voltages to the data driver 120. A number of the plurality of gray scale voltages V0 to V255 may be varied according to the number of gray scales displayed in the OLED device 100. Although the exemplary embodiment is described under the assumption that the gray scale displayed in the OLED display device 100 is 256 gray scales, the exemplary embodiment is not limited thereto.

According to the exemplary embodiment, when dimming is performed in the OLED display device 100, the preset dimming step is not provided. Instead, a gamma reference voltage appropriate for any selected brightness, i.e., any dimming step, is calculated, and optimal gray scale voltages for any selected brightness are generated by the gamma reference voltage, thereby making it possible to naturally implement a continuous dimming mode.

More specifically, according to the exemplary embodiment, a gamma table is determined to correspond to the OLED display device 100 emitting light at a maximum brightness level, so the data voltages corresponding to 0 to 255 gray scales are determined by the gamma table. Then, when a user selects any brightness level (dimming step), the data voltage corresponding to the selected brightness level is set to the gamma reference voltage based on the gamma table at the determined maximum brightness level, thereby making it possible to implement the dimming mode of the OLED display device 100.

Figure 4:
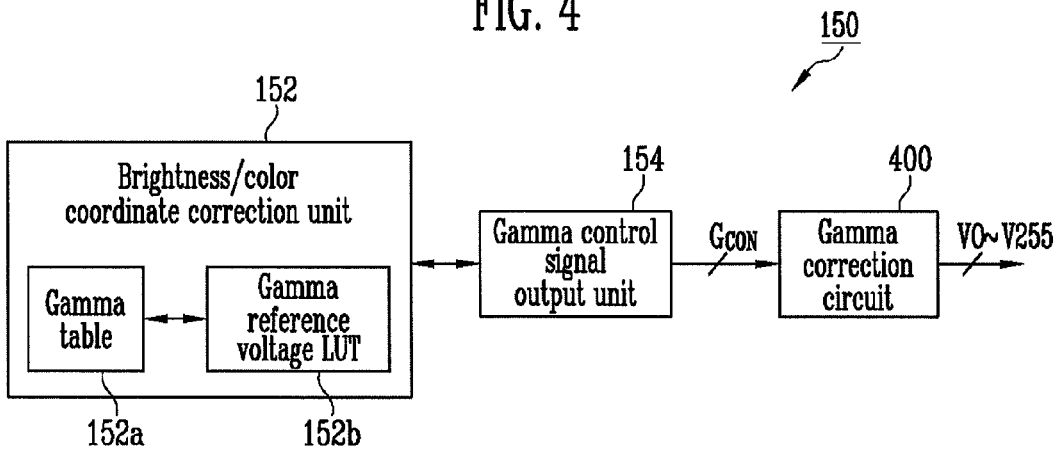
FIG. 4 is a block diagram showing a configuration of a gray scale voltage generator according to the exemplary embodiment.

FIG. 4 is a block diagram showing a configuration of the gray scale voltage generator 150 according to the exemplary embodiment. Referring to FIG. 4, the gray scale generator 150 is configured to include a brightness/color coordinate correction unit 152, a gamma control signal output unit 154, and a gamma correction circuit 400.

The brightness/color coordinate correction unit 152 includes a gamma table 152*a* set, e.g., configured to correspond to the OLED device emitting light at a maximum brightness level, and a gamma reference voltage lookup table (LUT) 152*b*. The LUT 152*b* includes voltage values of data of red, green, and blue data corresponding to each gray scale and brightness values at the maximum brightness level based on the gamma table 152*a*.

In an OLED display device, a displayed brightness of each completed product may be different from a target brightness due to a potential deviation in a manufacturing process of each product, aside from the implementation of the dimming mode. Therefore, in each OLED display device, a measured brightness of each product needs to be corrected to match the target brightness. However, when only brightness of the OLED display device is corrected, white balance may be distorted due to a difference in efficiency among a red pixel, a green pixel, and a blue pixel.

Therefore, color coordinate correction is performed together, e.g., simultaneously, with the brightness correction. In other words, according to the exemplary embodiment, a reference offset value is set in order to perform the gamma voltage correction on the preset reference gray scale (for example, a 255 gray scale, a 171 gray scale, a 87 gray scale, a 59 gray scale, etc.) based on the case in which the OLED emits light at the maximum brightness level through the brightness/color correction unit 152, and an additional, e.g., different, offset value for at least one of the remaining gray scales, other than the reference gray scale, is set to be applied to the gamma voltage correction corresponding to the gray scale, such that the optimal gamma table at the maximum brightness level is set.

In addition, the data voltages corresponding to 0 to 255 gray scales at the maximum brightness level are determined through the set optimal gamma table 152*a*. That is, the brightness/color correction unit 152 includes the gamma reference voltage LUT 152*b*, in which voltage values of red, green, and blue data corresponding to each gray scale and brightness at the maximum brightness level are listed. An operation of the bright/color coordinate correction unit 152 will be described hereinafter.

First, the pixel unit 140 (See FIG. 1) of the OLED display device 100 analyzes a screen that is light-emitted at the maximum brightness level (for example, 300 cd/m$^2$) and measures the brightness and the color coordinate for the reference gray scale. According to the exemplary embodiment, when data is implemented by 256 gray scales, e.g., 0 to 255 gray scales, the reference gray scale may be a 255 gray scale and a 177 gray scale.

That is, another gray scale data at a gamma tuning point lying on a brightness curve according to the gray scale, e.g., data of the 171 gray scale, in addition to the data of the maximum gray scale, e.g., data of the 255 gray scale, may be further applied to a panel. In this case, a screen analysis on a plurality of gamma turning points, i.e., a plurality of gray scales may be performed, such that precision of the brightness correction may be improved.

Further, a brightness comparison operation of measuring a chromaticity and a brightness of the screen, determining a color coordinate based on the measured chromaticity, and a brightness calculating difference between the target brightness and the measured brightness based on the measured brightness may be performed.

Further, a reference offset value for the reference gray scale is set according to the analysis result on the screen. More specifically, a reference brightness offset value allowing the brightness to be adjusted in accordance with the brightness difference between the target brightness and the reference gray scale obtained by the brightness comparison, and a reference color coordinate offset value allowing the chromaticity to be adjusted in accordance with the chromaticity for the reference gray scale may be set. For example, in the case of the reference offset value, a gamma adjustment capable of value compensating for the brightness difference between the target brightness and the measured brightness may be set to the reference brightness offset value, and a color coordinate shift value capable of correcting the color coordinate distorted due to the brightness correction, a problem in a process, or the like, may be set to the reference color offset value. At this time, the offset values corresponding to the brightness difference and/or the color coordinate may be derived from a preset equation, a graph, or the like.

Further, the brightness/color coordinate correction unit 152 may set the reference offset value in order to perform the gamma value correction on the reference gray scale and set the additional offset value for at least one of the remaining gray scales except for the reference gray scale to apply them to the gamma voltage correction corresponding to the gray scale. That is, the additional offset value for the gray scales, i.e., an offset value other than the reference gray scale, rather than the reference offset value, e.g., the 255 gray scale, is set based on the reference offset value, e.g., the 171 gray scale.

That is, in the brightness/color coordinate correction unit 152, the reference offset value for the reference gamma voltage corresponding to the reference gray scale is set, and the reference gamma voltage and the reference offset value are summed up, such that the corrected reference gamma voltage is generated. Then, when the additional offset value is set, the gamma voltage, e.g., a 180 gray scale, is corrected by summing up the reference offset value and the additional offset value.

The color coordinate correction may be performed reflecting the reference color coordinate offset value and the additional color coordinate offset value, similar to the brightness correction.

As described above, when the operation of the brightness/color coordinate correction unit 152 is performed, the gamma table 152*a* set to be optimized based on the case in which the OLED device emits light at the maximum brightness level, and the gamma reference voltage LUT 152*b*, in which the voltage values of data of the red, green and blue data corresponding to each gray scale and brightness at the maximum brightness level are listed based on the gamma table 152*a*, are generated in the brightness/color coordinate correction unit.

Figures 5A, 5B:
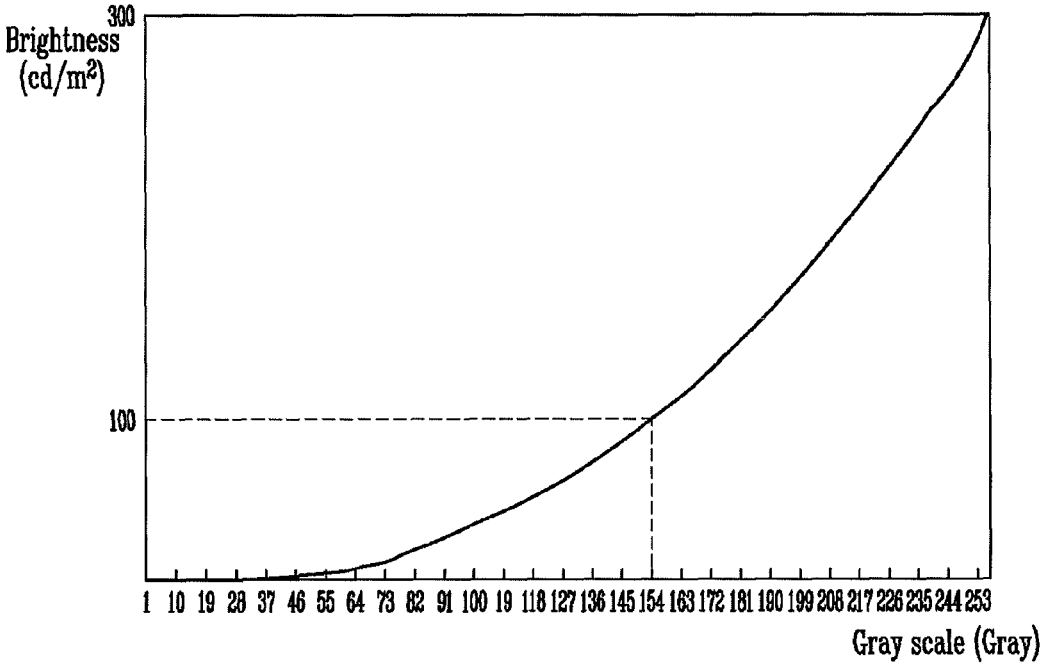
FIG. 5A is a graph showing a gamma table according to the exemplary embodiment.
FIG. 5B is a diagram showing a gamma reference look-up table (LUT) based on FIG. 5A.

The optimized gamma table 152*a* may be implemented as the curve shown in FIG. 5A, and the gamma reference LUT 152*b* based on the gamma table may be implemented as shown in FIG. 5B. Here, although the gamma table 152*a* may be implemented as individual gamma curves corresponding to the red, green, and blue data, only a gamma curve for specific color data is shown in FIG. 5A. Further, in the gamma table values of brightness and gray scale corresponding to the gamma curve may be also implemented in a look-up table form. That is, referring to the gamma table optimized at the maximum brightness level (300 cd/m$^2$) shown in FIG. 5A, it may be appreciated that the gray scale and the brightness are in proportion to each other in a one-to-one way. Therefore, the gray scale corresponding to the specific brightness may be confirmed.

In addition, the gamma reference LUT 152*b* shown in FIG. 5B is a LUT that includes voltage values of the red, green, and blue data corresponding to each gray scale and brightness at the maximum brightness level based on the gamma table shown in FIG. 5B. Referring to the gamma reference LUT 152*b*, the voltage values of the red, green, and blue data corresponding to the specific brightness and gray scale may be confirmed.

According to the exemplary embodiment, since the data voltage $V_{DATA}$ is in inverse proportion to the driving current $I_{OLED}$ applied to a pixel electrode of the light emitting device ($I_{OLED} \propto -V_{DATA}$) in view of characteristics of the OLED device, a low brightness and a low gray scale correspond to a high data voltage, and a high brightness and a high gray scale correspond to a low data voltage as shown in FIG. 5B.

Therefore, according to the exemplary embodiment, in implementing the dimming of the OLED device, e.g., when it is assumed that the predetermined brightness level (dimming step) is 100 cd/m$^2$, the gray scale value corresponding to the dimming step may be confirmed in FIG. 5A, and red, green, and blue data voltages corresponding to the brightness and gray scale values may be derived from FIG. 5B. That is, the most approximate value to the brightness level of the dimming step that is to be implemented is searched, thereby making it possible to determine the red, green, and blue data voltages corresponding to the value.

FIG. 5C shows a portion of a LUT representing an example of red, green, and blue data voltages selected in accordance with the selected dimming step (100 cd/m$^2$). Referring to FIG. 5C, it may be appreciated that, first, when a 154 gray scale is selected as an approximate value of the gray scale corresponding to the brightness level of 100 cd/m$^2$, the red, green, and blue data corresponding to the 154 gray scale are 3.0120(V), 3.1323(V), and 2.8485(V), respectively. That is, the data voltages may be calculated as the minimum reference voltage V255 corresponding to the dimming step, and the remaining medium reference voltages (V1, V15, V35, V59, V87, and V171) may be also calculated as optimal voltage values through the LUT.

Here, the calculated voltages of the red, green, and blue data are set to gamma reference voltages for the dimming step (100 cd/m$^2$). To this end, the gamma control signal output unit 154 outputs the a gamma reference voltage control signal GCON corresponding to the selected dimming step to the gamma correction circuit 400 with reference to the gamma table 152*a* and the gamma reference voltage look-up table 152*b* included in the brightness/color coordinate correction unit 152. That is, the gamma reference voltage control signal GCON is a signal controlling the voltages of the red, green, and blue data voltages calculated corresponding to the dimming step (100 cd/m$^2$) through the gamma reference voltage look-up table so as to be set to the reference voltages generated in the gamma correction circuit 400.

According to the exemplary embodiment, magnitudes of the gray scale voltages V0 to V255 output from the gamma correction circuit 400 are adjusted, thereby making it possible to adjust the brightness level (dimming step) of the OLED display device 100.

To this end, the brightness/color coordinate correction unit 152 receives a target brightness level TRG representing the brightness level of the OLED display device 100 and determines the gamma reference control signals GCON to be provided to the gamma correction circuit 400 according to the target brightness level TRG in order to adjust the brightness level of the OLED display device 100. Further, the gamma reference voltage control signals GCON may be determined with respect to the red, green, and blue data, respectively.

In addition, the gamma correction circuit 400 generates the gray scale voltages V0 to V255 in accordance with the corresponding brightness level of the gamma reference voltage control signal GCON output from the gamma control signal output unit to output the generated gray scale voltages V0 to V255 to the data driver 120.

Figure 6:
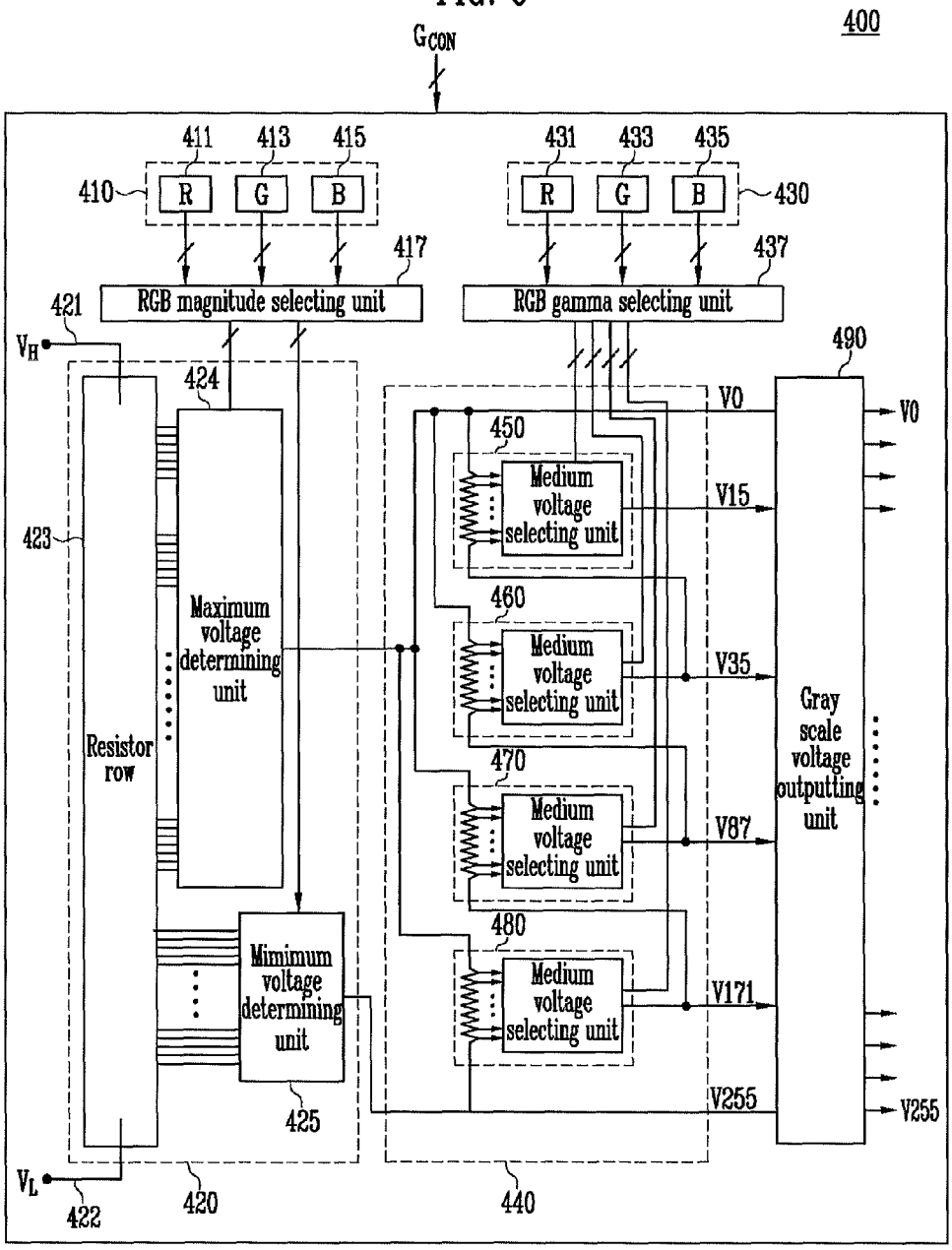
FIG. 6 is a block diagram showing a structure of a gamma correction circuit 708 according to the exemplary embodiment.

FIG. 6 is a block diagram showing a structure of the gamma correction circuit 400 according to the exemplary embodiment. It is noted, however, that the gamma correction circuit in FIG. 6 is only an example, so a configuration of the gamma correction circuit according to the exemplary embodiment is not limited thereto.

Referring to FIG. 6, the gamma correction circuit 400 according to the exemplary embodiment is configured to include a voltage magnitude adjusting unit 410, a maximum-minimum voltage determining unit 420, a gamma adjusting unit 430, a medium voltage unit 440, and a gray scale voltage outputting unit 490.

The gamma correction circuit 400 receives the gamma reference control signal GCON output from the gamma control signal output unit 154. Through the gamma reference control signal GCON, voltage levels of the reference voltages generated in the maximum-minimum voltage determining unit 420 and the medium voltage unit 440 are determined.

The voltage magnitude adjusting unit 410 outputs magnitude data determining magnitudes of the maximum and minimum gray scales to the maximum-minimum voltage determining unit 420, and includes an R voltage (red data voltage) magnitude adjusting unit 411, a G voltage (green data voltage) magnitude adjusting unit 413, and a B voltage (blue data voltage) magnitude adjusting unit 415. The R voltage magnitude adjusting unit 411 outputs R voltage magnitude data capable of determining magnitudes of an R maximum gray scale voltage and a R minimum gray scale voltage capable of displaying all R gray scales. Likewise, the G voltage magnitude adjusting unit 413 and the B voltage magnitude adjusting unit 415 output G voltage magnitude data capable of displaying all G gray scales and B voltage magnitude data capable of displaying all B gray scales, respectively.

An RGB magnitude selecting unit 417 sequentially outputs the R voltage magnitude data, the G voltage magnitude data, and the B magnitude data to the maximum-minimum voltage determining unit 420 one by one. The maximum-minimum voltage determining unit 420 includes a maximum power supply voltage ($V_H$) input terminal 421, a minimum power supply voltage ($V_L$) input terminal 422, a resistor row 423, a maximum voltage determining unit 424, and a minimum voltage determining unit 425. The maximum-minimum voltage determining unit 420 determines a maximum reference voltage V0 representing the minimum gray scale and a minimum reference voltage V255 representing the maximum gray scale among the voltage levels between the maximum power supply voltage $V_H$ and the minimum power supply voltage $V_L$ that are input from the outside based on the magnitude data input from the voltage magnitude adjusting unit 410.

The gamma correction unit 430 outputs gamma data capable of optimizing display characteristics of the display panel to the medium voltage unit 440 and includes an R gamma correction unit 433, a B gamma correction unit 435, and a RGB gamma selecting unit 437. The R gamma correction unit 431 outputs R gamma data, and the G gamma correction unit 433 and the B gamma correction unit 435 output G gamma data and B gamma data, respectively. The RGB gamma selecting unit 437 sequentially outputs the R gamma data, the G gamma data, and the B gamma data to the medium voltage unit 440 one by one.

The medium voltage unit 440 selects medium reference voltages V15, V35, V59, V87, and V171 corresponding to the gamma turning points at which gradients are varied on the gamma curve representing a relationship between each gray scale level and the gamma corrected gray scale based on the gamma data from the gamma correction unit 430. The medium voltage unit 440 includes a plurality of medium voltage selecting unit 450 to 480, wherein the number of the medium voltage selecting units may be the same as that of the gamma turning points in the gamma curve representing optimal display characteristics of the display panel.

The gray scale output unit 490 receives the reference voltages input from the plurality of medium voltage selecting units 450 to 480 and generates a plurality of voltage levels having a linear relationship within the range of each two reference voltages to gray scale voltages to output every gray scale voltage, thereby making it possible to display all gray scales, i.e., the 0 to 255 gray scale voltages V0 to V255. Although the gray scale voltage output unit 490 may be easily configured of a plurality of resistors having same resistance value to thereby be connected to in series with each other, the example embodiments are not limited thereto.

Figure 7:
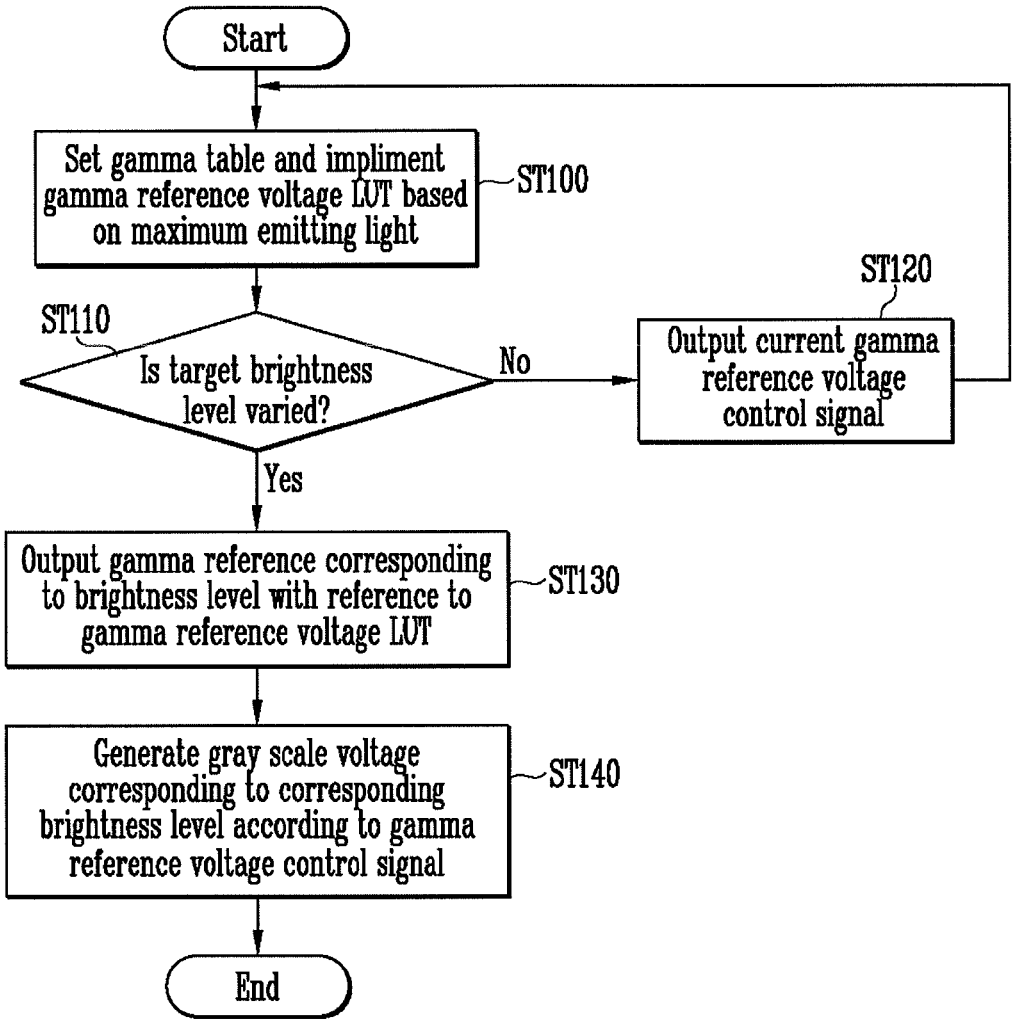
FIG. 7 is a flow chart showing a method of generating gray scale voltage according to the exemplary embodiment.

FIG. 7 is a flow chart showing a method of generating gray scale voltage according to the exemplary embodiment.

Referring to FIG. 4 to FIG. 7, first, a reference offset value is set in order to perform gamma voltage correction on the preset reference gray scale (for example, the 255 gray scale, the 171 gray scale, the 87 gray scale, the 59 gray scale, etc.) through a brightness/color coordinated correction unit 152 based on the case in which the OLED emits light at the maximum brightness level, and then an additional offset value for at least one of remaining gray scales except for the reference gray scale is set to thereby be applied to gamma voltage correction corresponding to the gray scale, such that the optimal gamma table at the maximum brightness level is set.

In addition, the data voltages corresponding to 0 to 255 gray scales at the maximum brightness level are determined through the set optimal set gamma table 152*a*. That is, the gamma reference voltage LUT 152*b*, in which voltage values of red, green, and blue data corresponding to each gray scale and brightness at the maximum brightness level are listed, is implemented (operation ST100).

Thereafter, in the case in which the target brightness is changed (operation ST100), i.e., a user selects a dimming step corresponding to a predetermined brightness level, the gamma control signal output unit 154 outputs the gamma reference voltage control signal GCON corresponding to the dimming step to the gamma correction circuit 400 with reference to the gamma table 152*a* and the gamma reference voltage LUT 152*b* included in the brightness/color coordinate correction unit 152 (operation ST130).

Here, the gamma reference control signal GCON is a signal controlling the gamma reference voltage calculated corresponding to the dimming step which is described above such that the gamma reference signal is generated in the gamma correction circuit 400.

However, in the case in which the target brightness is not varied (operation ST 110), the gamma reference voltage control signal GCON that is currently being output through the gamma signal control output unit 154 is continuously output to the gamma correction circuit 400 (operation ST 120).

Next, the gamma correction circuit 400 generates the gray scale voltages V0 to V255 corresponding to respective brightness levels according to the gamma reference voltage control signal GCON output from the gamma control signal output unit to output the generated gray scale voltages V0 to V255 to the data driver 120 (operation ST 140).

As a result, in the gray scale generator 150 according to the exemplary embodiment, as described in FIG. 4 to FIG. 6, the gamma table is determined based on the case in which the OLED device emits light at the maximum brightness level and data voltages corresponding to 0 to 255 gray scales are determined by the gamma table. Then, when a user selects any brightness level (dimming step), the data voltage corresponding to the selected brightness level is set to the gamma reference voltage based on the gamma table at the determined maximum brightness level, thereby making it possible to implement a natural and continuous dimming mode of the OLED device.

As set forth above, according to the exemplary embodiments, a gamma reference voltage which is appropriate for any selected brightness is calculated instead of dividing the brightness level into several steps, and optimal gray scale voltages for the any selected brightness is generated, thereby making it possible to naturally implement a continuous dimming mode.

In contrast, according to the related art, in order to implement the dimming mode of the OLED display device, a predetermined number of dimming steps (brightness levels) are preset, and a fixed gamma table is collectively applied for gamma implementation for each dimming step. However, brightness and color of the displayed image displayed for each dimming step may become non-uniform and brightness may be adjusted except for several preset dimming steps.

Further, in the organic light emitting display device according to the related art, a data driver generates data signals having a voltage according to gray scale of data based on a preset gamma reference voltage. However, in the case in which dispersion occurs in a panel property due to a deviation in a manufacturing process, images having different brightness may be displayed on each panel, even with respect to the same data signal.

While the example embodiments has been described in connection with certain exemplary embodiments, it is to be understood that the exemplary embodiments are not limited to the disclosed embodiments, but, on the contrary, is intended to cover various modifications and equivalent arrangements included within the spirit and scope of the appended claims, and equivalents thereof.

What is claimed is:

1. An apparatus for generating gray scale voltage for an organic light emitting diode (OLED) display device, the apparatus comprising:

a brightness/color coordinate correction unit including a gamma table and a gamma reference voltage look-up table, the gamma table including data corresponding to an image displayed on a pixel unit of the OLED display device at a first brightness level, and the gamma reference voltage look-up table including voltage values of red, green, and blue data corresponding to each gray scale and brightness values at the first brightness level in accordance with the gamma table;

a gamma control signal output unit configured to output a gamma reference voltage control signal corresponding to a second brightness level in accordance with the gamma table and the gamma reference voltage look-up table; and a gamma correction circuit configured to receive the gamma reference voltage control signal, to generate gray scale voltages corresponding to the second brightness level, and to output the generated gray scale voltages to a data driver, wherein the gamma table is set by applying a reference offset value to a preset reference gray scale in accordance with the first brightness level and by applying an additional offset value to at least one gray scale other than the preset reference gray scale for performing a gamma voltage correction.

2. The apparatus according to claim 1, wherein the first brightness level is a maximum brightness level.

3. The apparatus according to claim 2, wherein the maximum brightness level is about 300 cd/m$^2$.

4. The apparatus according to claim 1, wherein the gamma correction circuit is configured to generate a plurality of reference voltages and to distribute voltages between the plurality of reference voltages to generate the gray scale voltages.

5. The apparatus according to claim 1, wherein the gamma table is set by further applying a reference color coordinate offset to the preset reference gray scale based on the first brightness level, and an additional color coordinate offset value to the at least one gray scale other than the reference gray scale.

6. An apparatus for generating gray scale voltage for an organic light emitting diode (OLED) display device, the apparatus comprising:

a brightness/color coordinate correction unit including a gamma table and a gamma reference voltage look-up table, the gamma table including data corresponding to an image displayed on a pixel unit of the OLED display device at a first brightness level, and the gamma reference voltage look-up table including voltage values of red, green, and blue data corresponding to each gray scale and brightness values at the first brightness level in accordance with the gamma table;

a gamma control signal output unit configured to output a gamma reference voltage control signal corresponding to a second brightness level in accordance with the gamma table and the gamma reference voltage look-up table; and a gamma correction circuit configured to receive the gamma reference voltage control signal, to generate gray scale voltages corresponding to the second brightness level, and to output the generated gray scale voltages to a data driver, wherein the gamma correction circuit is configured to generate a plurality of reference voltages and to distribute voltages between the plurality of reference voltages to generate the gray scale voltages, and wherein the gamma reference voltage control signal is configured to control voltage values corresponding to the second brightness level in accordance with the gamma reference voltage look-up table, the voltage values corresponding to the reference voltages generated in the gamma correction circuit.

7. A method of generating a gray scale voltage of an organic light emitting diode (OLED) display device, the method comprising:

setting a gamma table including data corresponding to an image displayed on a pixel unit of the OLED display device at a first brightness level;

implementing a gamma reference look-up table including voltage values of red, green, and blue data corresponding to each gray scale and brightness values at the first brightness level in accordance with the gamma table;

selecting a second brightness level different from a current brightness level;

outputting a gamma reference voltage control signal corresponding to the second brightness level in accordance with gamma table and the gamma reference voltage look-up table;

generating gray scale voltages corresponding to the second brightness level in gamma reference voltage control signal; and outputting the generated gray scale voltages to a data driver, wherein the gamma table is set by applying a reference offset value to a preset reference gray scale in accordance with the first brightness level and by applying an additional offset value to at least one gray scale other than the preset reference gray scale for performing a gamma voltage correction.

8. The method according to claim 7, wherein the first brightness level is a maximum brightness level.

9. The method according to claim 7, wherein the gray scale voltages are generated by generating a plurality of reference voltages and distributing voltages between the reference voltages in a gamma correction circuit.

10. The method according to claim 9, wherein the gamma reference voltage control signal is a signal controlling the voltage values of data calculated corresponding to the second brightness level by the gamma reference voltage look-up table so as to be set to the reference voltages generated in the gamma correction circuit.

11. The method according to claim 7, wherein the gamma table is set by additionally applying a reference color coordinate offset value for the preset reference gray scale based on the first brightness level, and an additional color coordinate offset value for the at least one gray scale other than the reference gray scale.

* * * * *